US006370744B1

(12) United States Patent
Mendez

(10) Patent No.: US 6,370,744 B1
(45) Date of Patent: Apr. 16, 2002

(54) CAR SHAPED COFFIN CONSTRUCTION

(76) Inventor: Daniel Mendez, 42321 Thornton Ave., Hemet, CA (US) 92544

( * ) Notice: Subject to any disclaimer, the term of this patent is extended or adjusted under 35 U.S.C. 154(b) by 0 days.

(21) Appl. No.: 09/545,750

(22) Filed: Apr. 10, 2000

(51) Int. Cl.[7] ..... A61G 17/00
(52) U.S. Cl. ..... 27/2
(58) Field of Search ..... 27/1, 2, 35, 19, 27/27; D99/1, 3, 30; 446/465

(56) References Cited

U.S. PATENT DOCUMENTS

| | | | | |
|---|---|---|---|---|
| 1,746,195 A | * | 2/1930 | Knaus | 27/19 |
| D163,837 S | | 7/1951 | Waldron | |
| D188,458 S | | 7/1960 | Flynn | |
| D220,999 S | | 6/1971 | Poulin | |
| D221,646 S | | 8/1971 | Boulanger | |
| 4,861,311 A | * | 8/1989 | Alskog | 446/465 X |
| D315,977 S | | 4/1991 | Best | |
| D328,176 S | | 7/1992 | Ruble | |
| 5,522,116 A | * | 6/1996 | Enneking et al. | 27/27 X |
| D374,961 S | | 10/1996 | Richardson | |
| 5,689,869 A | * | 11/1997 | Linville et al. | 27/27 X |
| D390,318 S | | 2/1998 | Richardson | |
| 6,102,771 A | * | 8/2000 | Poznick et al. | 446/465 |

OTHER PUBLICATIONS

"Driving into the next world", The Providence Journal Company, 1998.*

* cited by examiner

*Primary Examiner*—B. Dayoan
*Assistant Examiner*—William L. Miller
(74) *Attorney, Agent, or Firm*—Henderson & Sturm LLP

(57) ABSTRACT

A car shaped coffin construction (10) including a coffin receptacle member (20) configured to represent the lower portion (21) of a stylized vehicle chassis below the vehicle chassis window line (30) and including recesses (35) formed in both the front (24) and rear (25) bumpers, as well as side exhaust pipe rails (27) which form hand grip surfaces for pall bearers, and a coffin lid member (50) hingedly connected to one side of the coffin receptacle member (20) and configured to represent the upper portion (21') of a stylized vehicle chassis. The coffin lid member (50) is provided with a simulated side view mirror (56) which serves as a handle for raising and lowering the coffin lid member (50) relative to the coffin receptacle member (20).

17 Claims, 2 Drawing Sheets

CAR SHAPED COFFIN CONSTRUCTION

BACKGROUND OF THE INVENTION

1. Field of the Invention

The present invention relates to the field of customized coffin constructions in general, and in particular to a car shaped coffin construction.

2. Description of Related Art

As can be seen by reference to the following U.S. Pat. Nos. Des. 163,837; Des. 188,458; Des. 220,999; Des. 221,646; Des. 315,977; Des. 328,176; Des. 374,961; Des. 390,318, the prior art is replete with myriad and diverse customized coffin constructions.

While all of the aforementioned prior art constructions are more than adequate for the basic purpose and function for which they have been specifically designed, they are uniformly deficient with respect to their failure to provide a simple, efficient, and practical way for a deceased person to be laid to rest in a coffin that is contoured to resemble their favorite automobile.

As most people are aware, many individuals if given the choice prior to their demise, would prefer to be interred in a manner that befitted their own personal lifestyle and favorite interests.

In fact, it is not uncommon for individuals to be interred inside their favorite automobile. However, that is a very expensive process that is not within the means of an average person.

As a consequence of the foregoing situation, there has existed a longstanding need for a new and improved type of coffin construction that is customized to represent the deceased favorite automobile while still having the same general dimensions of an average casket or coffin, and the provision of such a construction is a stated objective of the present invention.

BRIEF SUMMARY OF THE INVENTION

Briefly stated, the coffin construction that forms the basis of the present invention comprises in general, a base unit, a liner unit that is dimensioned to be received in the base unit, and a lid unit that is adapted to be hingedly connected to the base unit and overlie the liner unit.

As will be explained in greater detail further on in the specification, both the lid unit and the base unit are configured to represent the stylized contour and appearance of a particular make and model of automobile that was the favorite of the deceased and which will contain the mortal remains of the deceased in their final resting place.

In addition, several stylized conventional vehicle chassis structural components are represented on the exterior of the coffin construction such as the front and rear bumpers, side exhaust pipe rails, and a side view mirror. Those stylized components are either recessed or configured to represent hand grip surfaces for pall bearers and a handle element for raising and lowering the lid unit relative to the base unit.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
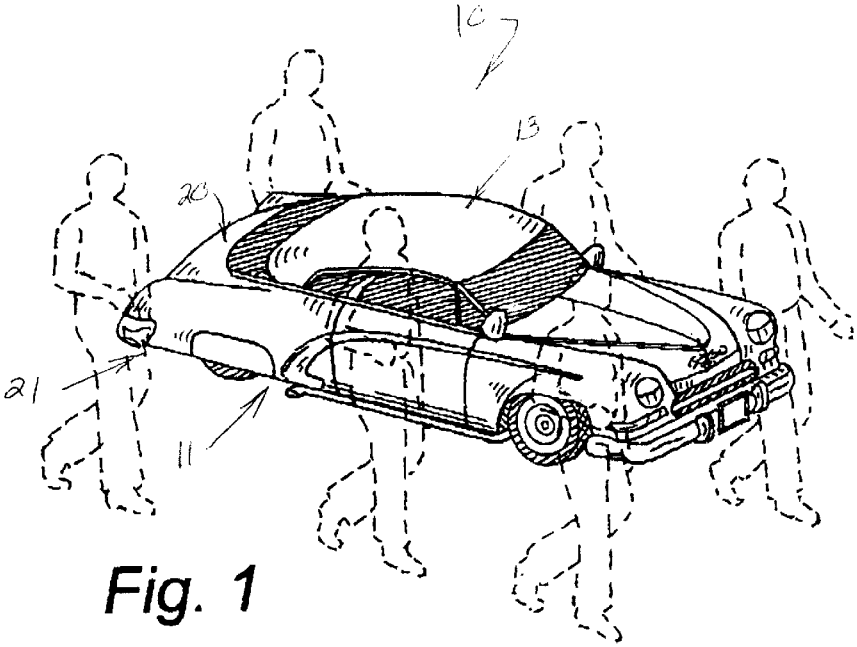
FIG. 1 is a perspective view of the coffin construction of this invention being borne by six pall bearers.

As can be seen by reference to the drawings, and in particular to FIG. 1, the car shaped coffin construction that forms the basis of the present invention is designated generally by the reference number 10. The construction 10 comprises in general a base unit 11, a liner unit 12, and a lid unit 13. These units will now be described in seriatim fashion.

Figure 2:
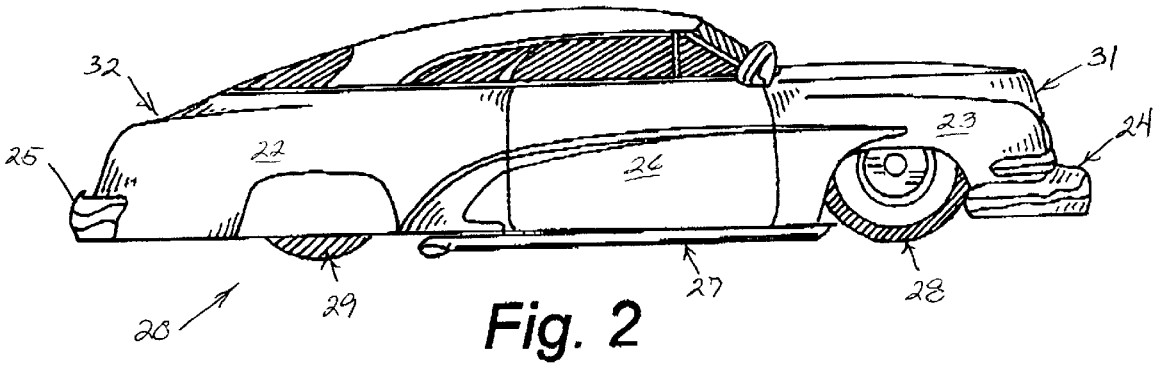
FIG. 2 is a side elevation view of the coffin construction in the closed position.
Figure 3:
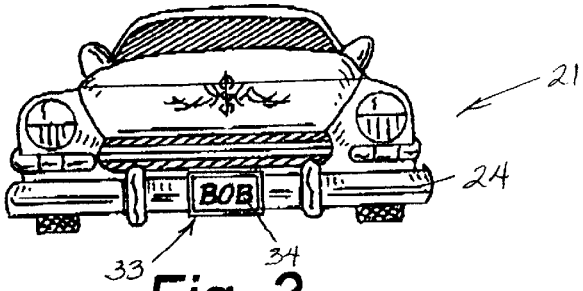
FIG. 3 is a front elevation view of the coffin construction in the closed position.
Figure 4:
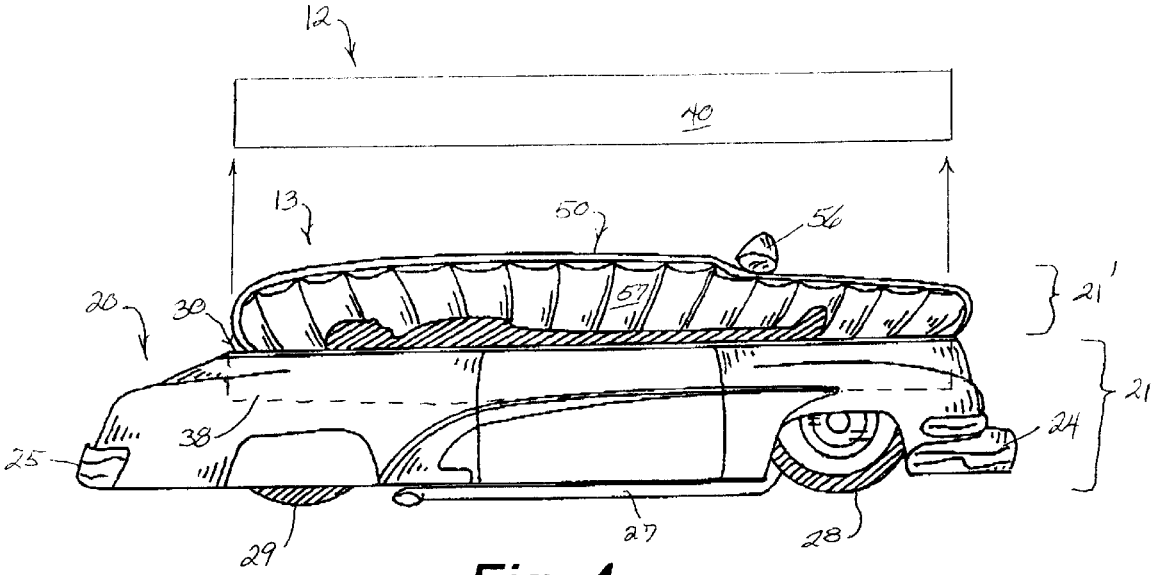
FIG. 4 is an exploded perspective view of the coffin construction.

As shown in FIGS. 2 through 4, the base unit 11 comprises a coffin receptacle member 20 contoured to resemble the lower chassis 21 of a stylized automobile including the front 22 and rear 23 fenders and wheels, the front 24 and rear 25 bumpers, the doors 26, the stylized side rail exhaust pipe 27, the front 28 and rear 29 wheels and the lower portion of the front hood 31 and the rear trunk 32 of the stylized chassis 21 below the window line designated generally as 30 of the stylized automobile.

Figure 5:
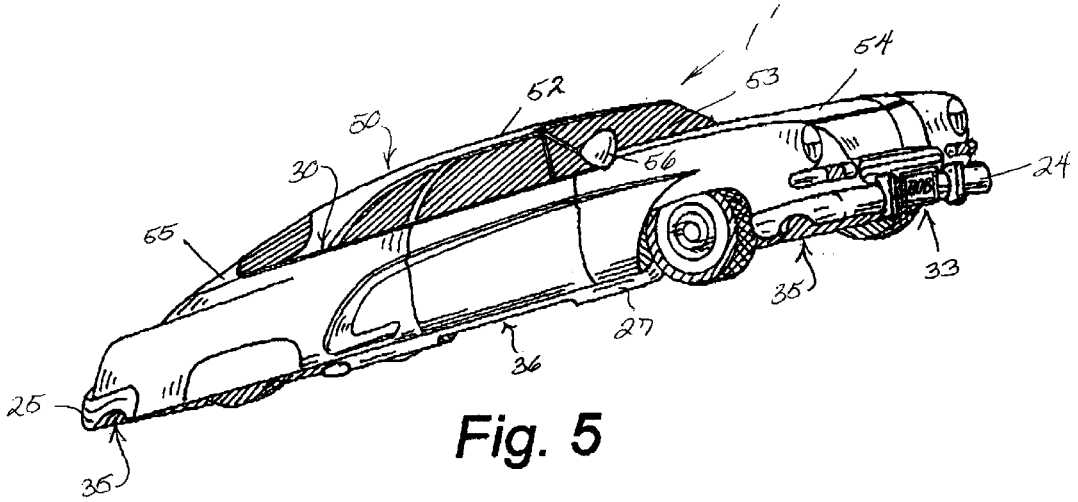
FIG. 5 is a perspective view of the coffin construction showing the hand rail gripping surfaces.
Figure 6:
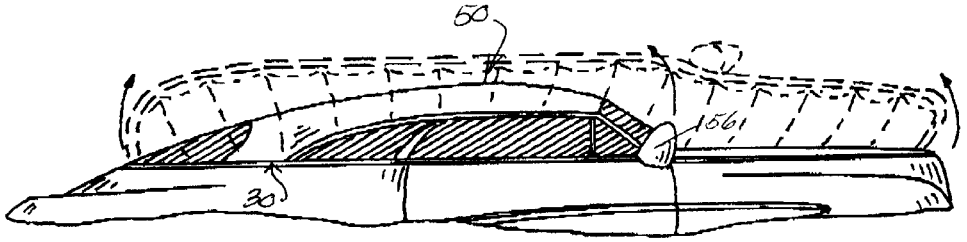
FIG. 6 is an isolated perspective view of the upper portion of the base and lid units.

As can best be seen by reference to FIGS. 3 and 5, at least the front bumper 24 is provided with a simulated license plate holder 33 adapted to receive a personalized license plate 34 bearing the deceased name, and the bottom surface of both the front 24 and rear 25 bumpers are provided with recesses 35 that serve as hand hold gripping surfaces for some of the pall bearers.

In addition, in the preferred embodiment of the invention depicted in FIGS. 2 and 4, the rail exhaust pipes 27 have a generally elongated cylindrical configuration that will function as a hand hold gripping surface for the remaining pall bearers. However, the alternate version of the preferred embodiment depicted in FIG. 5, the rail exhaust pipes 27 may also be provided with pronounced recesses 36 to provide hand grips for the pall bearers on the opposite sides of the coffin receptacle member.

As can best be seen by reference to FIG. 4, the coffin receptacle member 20 is further provided with an interior chamber 38 outlined in phantom which is dimensioned to receive the coffin liner unit 12. The liner unit 12 comprises a generally rectangular liner member 40 whose interior surface may be provided with simulated leather upholstery (not shown) in keeping with the automotive theme of the coffin construction.

As can also be appreciated by reference to FIG. 4, the coffin lid unit 13 comprises a coffin lid member 50 which is hingedly connected in the conventional manner to one side of the coffin receptacle member 20. The exterior surface of the coffin lid member 50 is configured to resemble the upper chassis 21' of a stylized automobile including the roof 52, windows 53, and the upper portions of both the front hood 54 and rear trunk 55.

In addition, a simulated side view mirror 56 is provided on the free side of the coffin lid member 50 to provide a handle element for the raising and lowering of the coffin member 50. The interior of the coffin lid member 50 is also provided with a simulated leather upholstery 57 that matches the simulated leather upholstery (not shown) on the interior of the coffin liner member 40.

At this juncture, it should be appreciated that the contours and configuration of the exterior surfaces of the coffin receptacle member 20 and the coffin lid member 50 can be varied to provide stylized representation of different automobile makes and models depending on the personal preferences of the deceased or their surviving kin.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A car shaped coffin construction comprising:

a base unit including a coffin receptacle member configured to represent a lower portion of a stylized vehicle chassis below a window line of the stylized vehicle chassis and including front and rear bumpers, front and rear fenders, side doors, front and rear wheels, and a lower portion of both a front hood and rear trunk of the stylized vehicle chassis;

a lid unit including a coffin lid member operatively connected to one side of the coffin receptacle member and configured to represent an upper portion of the stylized vehicle chassis above the window line of the stylized vehicle chassis and including a roof, windows, and an upper portion of both the front hood and rear trunk of the stylized vehicle chassis; and a plurality of recesses provided on the lower portion of the vehicle chassis to provide hand grip surfaces for pall bearers wherein at least some of the plurality of recesses are provided in the front and rear bumpers of the stylized vehicle chassis.

2. The coffin construction as in claim 1 wherein the lid members is provide with a side view mirror which serves as a handle element for raising and lowering the coffin lid member relative to the coffin receptacle member.

3. The coffin construction as in claim 2 wherein the lower portion of the stylized vehicle chassis includes side exhaust pipe rails formed on the opposite sides of the coffin receptacle member.

4. The coffin construction as in claim 3 wherein each of the side exhaust pipe rails have a generally elongated cylindrical configuration that is dimensioned to provide a hand grip surface for pall bearers.

5. The coffin construction as in claim 3 wherein each of the side exhaust pipe rails are provided with at least one recess that will provide a hand grip surface for pall bearers on the opposite sides of the coffin receptacle member.

6. The coffin construction as in claim 3 wherein at least one of the front and rear bumpers on the coffin receptacle member is provided with a license plate holder and a personalized license plate.

7. The coffin construction as in claim 3 wherein the interior of at least one of the coffin lid member and the coffin receptacle member is provided with simulated leather upholstery.

8. The coffin construction as in claim 3 wherein both the coffin lid member and the coffin receptacle member are provided with simulated leather upholstery.

9. The coffin construction as in claim 1 wherein the interior of at least one of the coffin lid member and the coffin receptacle member is provided with simulated leather upholstery.

10. The coffin construction as in claim 1 wherein both the coffin lid member and the coffin receptacle member are provided with simulated leather upholstery.

11. The coffin construction as in claim 1 further including:

a liner unit including a generally rectangular liner member dimensioned to be received in the coffin receptacle member.

12. The coffin construction as in claim 11 wherein at least one of the coffin lid member and the liner member are provided with simulated leather upholstery.

13. The coffin construction as in claim 11 wherein both the coffin lid member and the liner member are provided with simulated leather upholstery.

14. A car shaped coffin construction comprising:

a base unit including a coffin receptacle member configured to represent a lower portion of a stylized vehicle chassis below a window line of the stylized vehicle chassis and including front and rear bumpers, front and rear fenders, side doors, front and rear wheels, and a lower portion of both a front hood and rear trunk of the stylized vehicle chassis;

a lid unit including a coffin lid member operatively connected to one side of the coffin receptacle member and configured to represent an upper portion of the stylized vehicle chassis above the window line of the stylized vehicle chassis and including a roof, windows, and an upper portion of both the front hood and rear trunk of the stylized vehicle chassis wherein the lid member is provided with a side view mirror which serves as a handle element for raising and lowering the coffin lid member relative to the coffin receptacle member; and a plurality of recesses provided on the lower portion of the vehicle chassis to provide hand grip surfaces for pall bearers.

15. The coffin construction as in claim 14 further including:

a liner unit including a generally rectangular liner member dimensioned to be received in the coffin receptacle member.

16. A car shaped coffin construction comprising:

a base unit including a coffin receptacle member configured to represent a lower portion of a stylized vehicle chassis below a window line of the stylized vehicle chassis and including front and rear bumpers, front and rear fenders, side doors, front and rear wheels, and a lower portion of both a front hood and rear trunk of the stylized vehicle chassis;

a lid unit including a coffin lid member operatively connected to one side of the coffin receptacle member and configured to represent an upper portion of the stylized vehicle chassis above the window line of the stylized vehicle chassis and including a roof, windows, and an upper portion of both the front hood and rear trunk of the stylized vehicle chassis;

a plurality of recesses provided on the lower portion of the vehicle chassis to provide hand grip surfaces for pall bearers; and a liner unit including a generally rectangular liner member dimensioned to be received in the coffin receptacle member wherein at least some of the plurality of recesses are provided in the front and rear bumpers of the stylized vehicle chassis.

17. The coffin construction as in claim 16 wherein the lid member is provided with a side view mirror which serves as a handle element for raising and lowering the coffin lid member relative to the coffin receptacle member.

* * * * *